US006865902B2

(12) United States Patent
Seiss

(10) Patent No.: US 6,865,902 B2
(45) Date of Patent: Mar. 15, 2005

(54) GRATE FOR REFRIGERATED COOLER

(75) Inventor: Richard A. Seiss, Spartanburg, SC (US)

(73) Assignee: Carrier Commercial Refrigeration INC, Aurora, IL (US)

( * ) Notice: Subject to any disclaimer, the term of this patent is extended or adjusted under 35 U.S.C. 154(b) by 0 days.

(21) Appl. No.: 10/410,555

(22) Filed: Apr. 9, 2003

(65) Prior Publication Data

US 2004/0200231 A1 Oct. 14, 2004

(51) Int. Cl.[7] ..... A47F 3/04

(52) U.S. Cl. ..... 62/255; 211/181.1; 312/351

(58) Field of Search ..... 126/540, 152 R, 126/152 B, 337 R, 333, 339; 211/181.1, 191; 248/153; 312/42, 351

(56) References Cited

U.S. PATENT DOCUMENTS 1,995,399 A * 3/1935 Reedy et al. ..... 126/339
3,784,044 A * 1/1974 Bruggerman et al. ..... 206/512
3,792,595 A * 2/1974 Willis ..... 62/414
4,972,682 A * 11/1990 Smith et al. ..... 62/405
5,101,643 A * 4/1992 Hicke ..... 62/407
6,050,663 A * 4/2000 Schoellmann ..... 312/408
6,164,194 A * 12/2000 Westmoreland ..... 99/426
6,520,354 B1 * 2/2003 Skvorecz ..... 211/181.1

FOREIGN PATENT DOCUMENTS

DE 10059466 * 6/2002

* cited by examiner

*Primary Examiner*—William E. Tapolcai

(57) ABSTRACT

A forced air cooler (10) includes a cabinet (20) defining a lower chamber (30) wherein product is stored and an upper chamber (40) housing a pair of fans (62) and (64) positioned intermediate spaced evaporators (52) and (54). A support grate (90) disposed on the floor of the cabinet (20) supports the product off the floor and includes integral side fences (94) and (96) which serve to space the product away from the side walls (26) and (28) of the cabinet. The fans (62) and (64) draw air through the evaporators (52) and (54), respectively, and direct the cooing air through the openings provided by the slots (68) in the diffuser plate (66) to provide a uniformly distributed flow of cooling air, at its coolest condition, downwardly into the lower chamber (30) to pass over the product stored therein. Upon reaching the floor of the lower chamber, the cooling airflow passes along the surface of the floor and is drawn into the lower return air duct (70) and thence into side air ducts (76) and (78) to return to the upper chamber (40) and be again drawn through the evaporators (52) and (54).

1 Claim, 4 Drawing Sheets

GRATE FOR REFRIGERATED COOLER

BACKGROUND OF THE INVENTION

The present invention relates generally to refrigerated coolers and most particularly to an improved grate supporting milk container caddies in forced air cooler of the type adapted for use in schools as a milk cooler.

Forced air coolers are commonly used in schools to chill milk containers for self-service access. Students passing through the cafeteria line reach in to the cooler through a door opening on one side of the cooler or through either of a pair of door openings provided on opposite sides on the cooler to accommodate two lines of students passing by the cooler. The door/doors when open provide access to the interior of the cooler wherein the milk containers are stored. In conventional forced air coolers, the refrigeration system includes an evaporator/fan system adapted to blow refrigerated air into the uppermost region of the cooler interior across the top of the cooler and collect return air from the bottom region of the cooler.

In U.S. Pat. No. 3,196,632, Buffington discloses a forced air cooler including a cabinet defining a relatively long and relatively low rectangular chamber for chilling containers and having an upper portion of the front wall of the cabinet which is removable to provide access to the chilled product within the chamber. An evaporator and circulating fan are disposed along the back wall of the chamber. Refrigerated air discharges horizontally across the top of the chamber towards the front and the opposite end walls of the chamber and returns, for cooling and recirculation, to a fan inlet which is centrally located at the lower portion of the back wall of the chamber. Thus, the refrigerated air passes outwardly across the top of the chamber, thence downwardly along the front and side walls and back to the fan inlet. In the forced air circulation pattern thus established, the refrigerated air chills the product stacked within the chamber.

In U.S. Pat. No. 4,972,682, Smith et al. disclose a forced air cooler defining a rectangular enclosure having a door in the front wall and top thereof for providing self-service access to individuals, such as for example students passing through a school cafeteria line, to individual service beverage containers, such as milk cartons and the like. A plenum housing an evaporator/fan system is disposed in the uppermost region of the cooler atop the chilled enclosure housing the beverage containers and a condenser/compressor system disposed beneath the floor of and exteriorly of the chilled enclosure. An air return air duct is provided along the back wall of the enclosure with its inlet opening to the lower portion of the enclosure and its outlet to the fan plenum. Refrigerated air discharges horizontally outwardly along the length of the plenum toward the front wall of the enclosure and flows generally downwardly to and down the front wall of the enclosure to the floor thereof, thence along the floor toward the back wall of the enclosure and thence upwardly through the air return duct and to return to the fan plenum. A wire grid is placed atop the floor of the cooler to support the baskets of milk containers off the floor of the cooler such that an air flow gap is provided superadjacent the cooler floor and beneath the milk containers. A wire fence, functioning to space the product away from the front wall, is mounted by means of brackets and screws to the inner surface of the front wall of the cooler superadjacent the bottom wire grid.

Although the fence and bottom wire grid disclosed in Smith et al. are in combination effective to space the product stored within the chamber away the front wall and floor of the cabinet, respectively, their presence complicates cleaning. Before the floor and lower portion of the front wall of the cabinet of smith et al. maybe cleaned, it is necessary to remove the brackets mounting the fence to the wall and thereafter lift the fence and the bottom gird from the cooler. Therefore, to facilitate cleaning of the cabinet, there exists a need for a bottom grid and fence arrangement which merely sits within the chamber rather than be bracket mounted to the wall.

SUMMARY OF THE INVENTION

It is an object of the present invention to provide a self-supporting support grate for use in forced air coolers or like cabinets wherein product stored-therein is to be spaced from the surrounding walls, as well as from the floor of the cabinet. It is a further object of the present invention to provide such a support grate having edge fences formed integrally with and extending from a bottom grid.

The support grate of the present invention is adapted for disposition within a cabinet having four generally vertically extending walls and a floor panel that cooperatively define a chamber so as to support product above the floor of the cabinet and away from at least one wall of the cabinet. In accordance with the present invention, the support grate is a relatively open wire grid having at least one edge fence formed integrally with and extending from the bottom grid. In a preferred embodiment, the support grate comprises a relatively open framework having a generally horizontally extending deck adapted to support product, a first edge fence integral with the deck and extending generally vertically upwardly from a first edge of the deck, and a second edge fence integral with the deck and extending generally vertically upwardly from a second edge of the deck. Support legs extend downwardly from the deck to support the deck off the floor of the cabinet. Advantageously, the support grate may be formed of welded metal wire powder coated with an epoxy or plastic material.

BRIEF DESCRIPTION OF THE DRAWINGS

The various features and advantages of this invention will become apparent to those skilled in the art from the following detailed description of the currently preferred embodiment with reference to the accompany drawings wherein.

DETAILED DESCRIPTION OF THE PREFERRED EMBODIMENT

Figure 1:
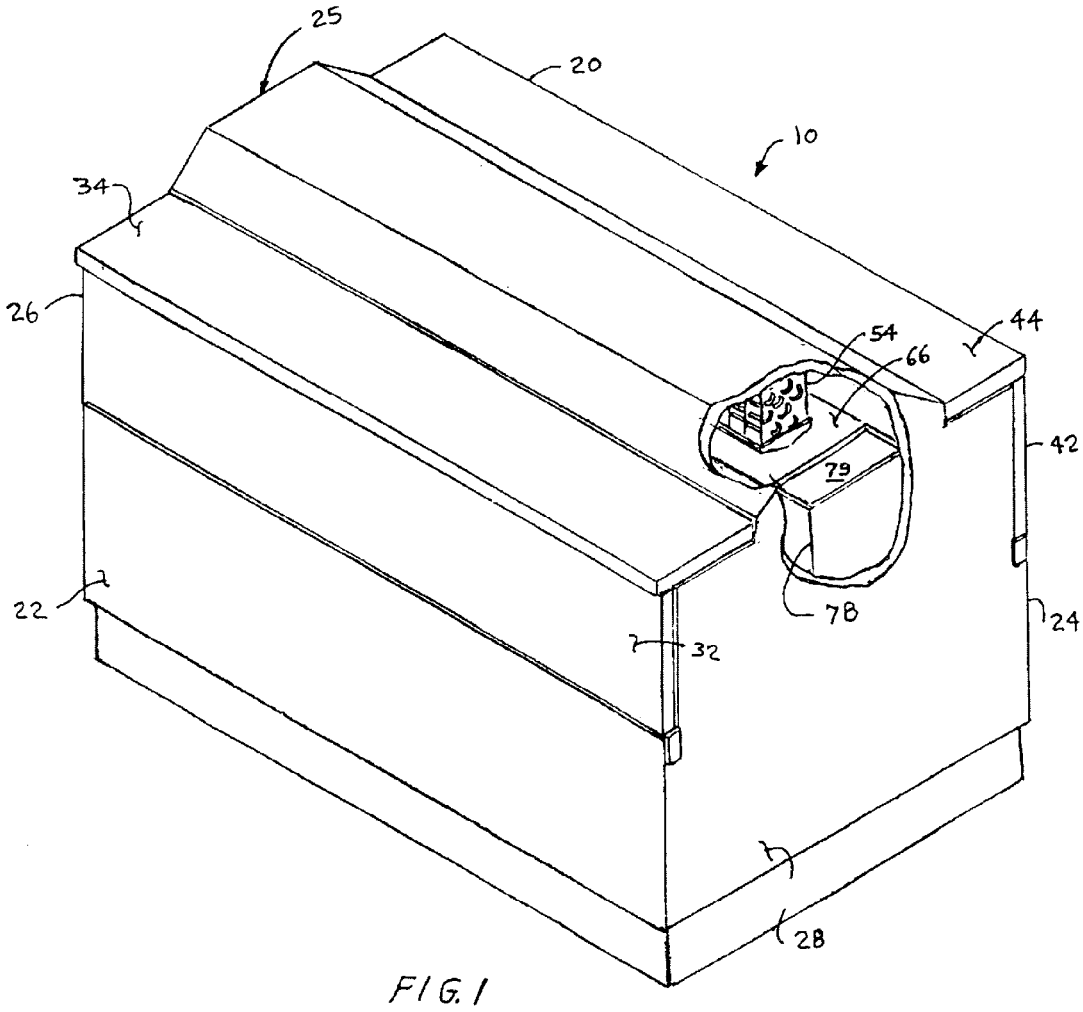
FIG. 1 is a perspective view, partly sectioned, of an embodiment of a forced air cooler.

Referring now to the accompanying drawings the forced air cooler 10 is depicted, for purposes of illustration, as a twin access milk cooler/server for providing ready access from either the front and/or back of the cooler to cartons of milk stored therein by individual passing through a cafeteria line. It is to be understood, however, that the support grate of the present invention may be useful in any type of cabinet wherein it is desired to maintain product within the cabinet off the floor of the cabinet and away from one or more of the bounding walls thereof.

The forced air cooler 10 includes a cooler cabinet 20 defining a lower chamber 30 wherein articles to be maintained in a chilled environment, such as for example cartons of milk disposed in carton caddies 80, are stacked and an upper chamber 40 superadjacent the lower chamber 30. The cabinet 20 includes insulated front wall 22, insulated back wall 24, insulated side walls 26 and 28 disposed at and connecting between opposite ends of the front and back walls, insulated floor panel 23 and insulated top panel 25. The top panel 25 includes an upper section 25*a* extending horizontally between the side walls 26 and 28, a forward section 25*b* extending outwardly and downwardly along the forward edge of the upper section 25*a* between the side walls 26 and 28 at an acute angle to the vertical, and an aft section 25*c* extending outwardly and downwardly along the aft edge of the upper section 25*c* between the side walls 26 and 28 at an acute angle to vertical.

The cabinet 20 has a pair of access openings 35 and 45 provided along the front and back, respectively, of the cabinet 20. Access to the chamber 30 of the cabinet 20 through opening 35 is made available through a double door system comprising a first front panel 32 suitably hinged to the front wall 22 for pivotal movement about a horizontal axis 31 and a second front panel 34 suitably hinged to the frontal edge of the forward section 25*b* of top panel 25 for pivotal movement about a horizontal axis 33. Similarly, access to the chamber 30 of the cabinet 20 through opening 45 is made available through a double door system comprising a first rear panel 42 suitably hinged to the back wall 24 for pivotal movement about a horizontal axis 41 and a second rear panel 44 suitably hinged to the rearward edge of the aft section 25*c* of top panel 25 for pivotal movement about a horizontal axis 43.

Figure 2:
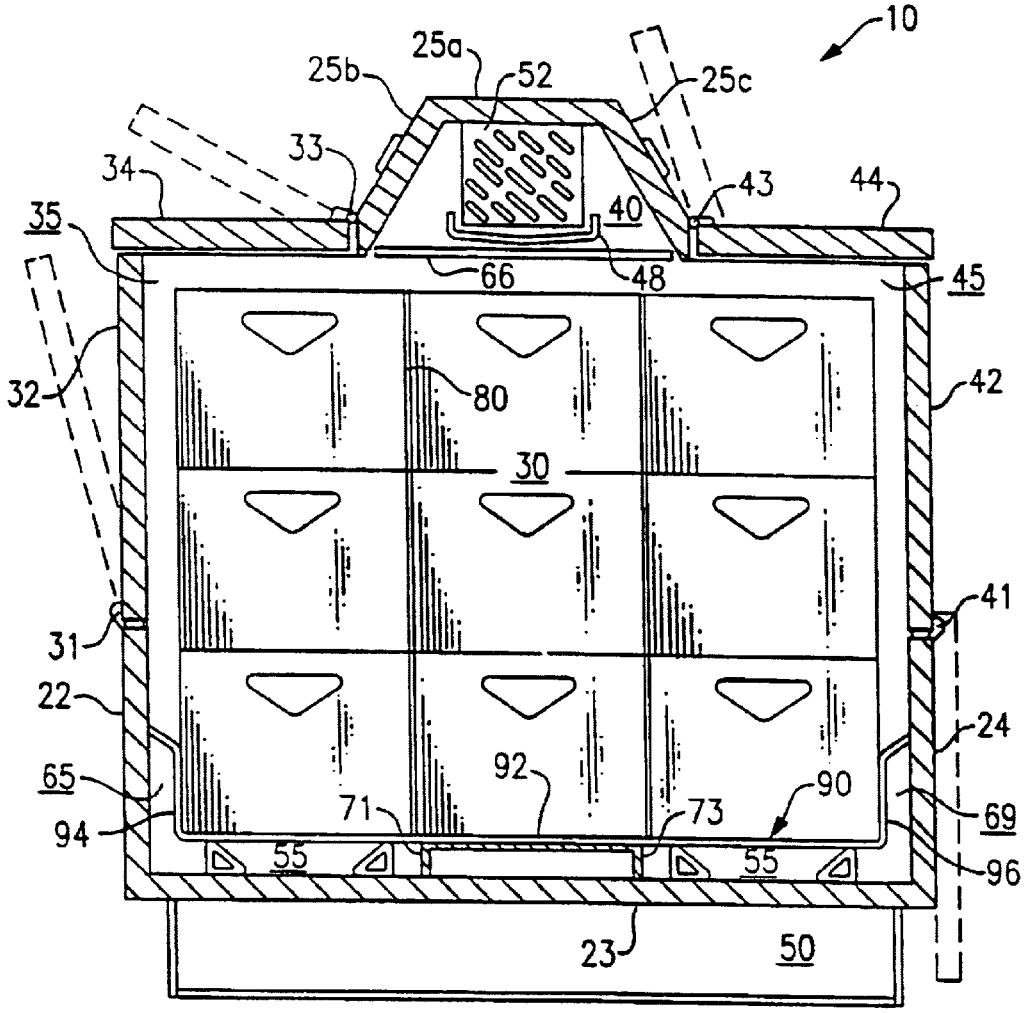
FIG. 2 is a sectional elevation view, taken along line 2—2 of FIG. 1.
Figure 3:
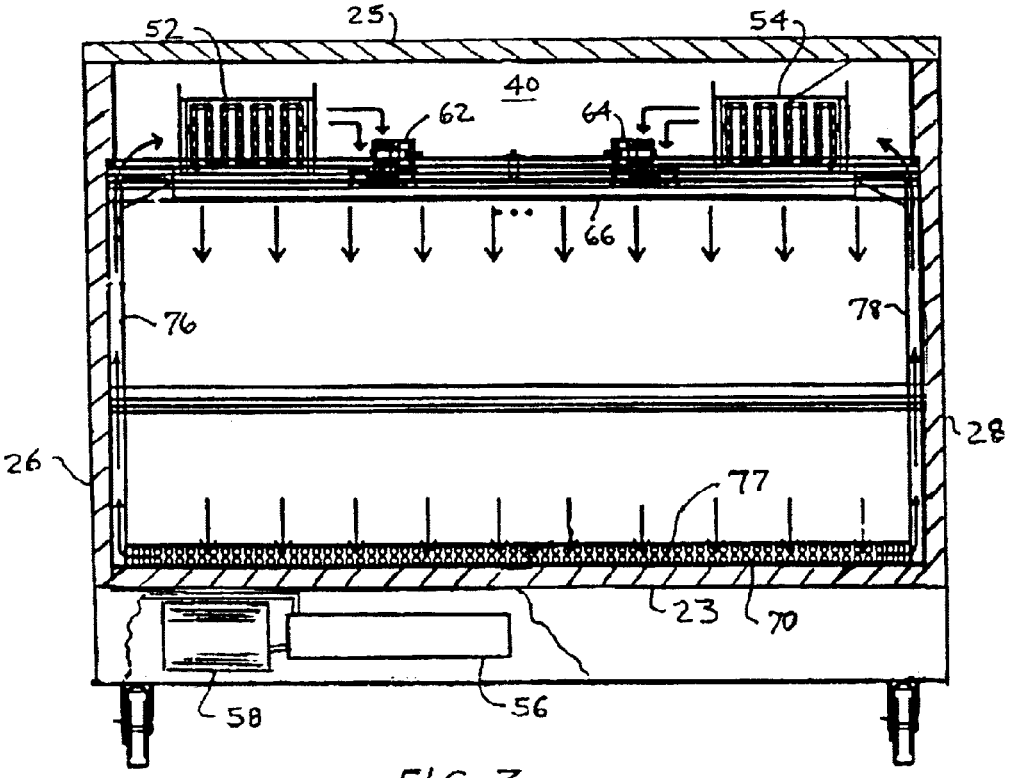
FIG. 3 is a sectional elevation view taken along line 3—3 of FIG. 1.

As best seen in FIGS. 2 and 3, a plurality of milk carton caddies 80 are stacked in columns, one atop another, within the chamber 30 and supported above the floor panel 23 on base section 92 of grate 90 so as to provide a gap 55 between the upper surface of floor panel 23 and the bottoms of the caddies 80. The grate 90 merely sits upon the upper surface of the floor panel 23 supported on legs 95 that extend downwardly from the base section 92. Preferably, the support legs 95 are formed integrally with the base section 92.

Figure 5:
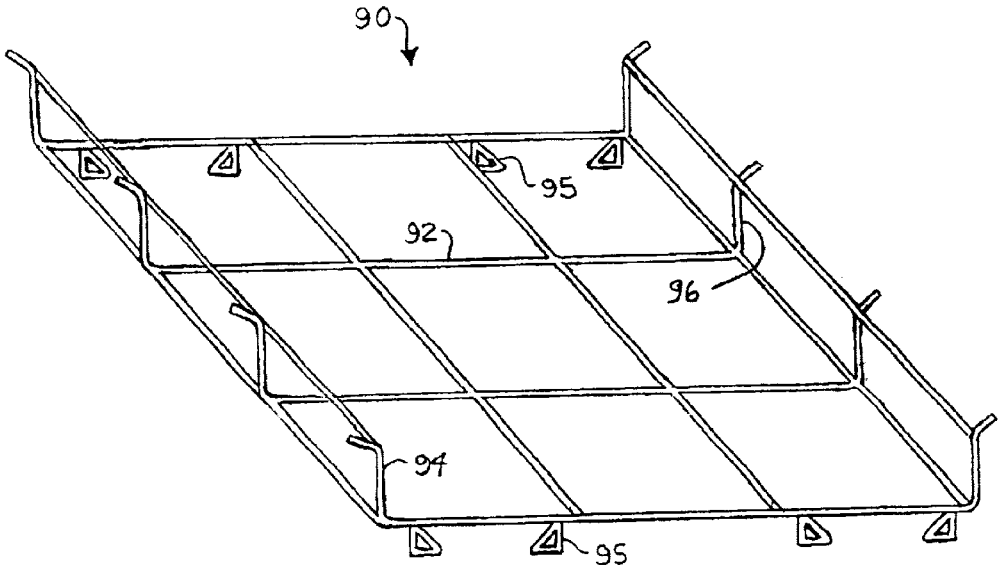
FIG. 5 is a perspective view of the support grate of the present invention.

Referring now to FIG. 5, the rack 90 comprises a relatively open, welded wire framework, preferably powder coated with an epoxy or plastic material, having a horizontal base section 92 and vertically extending edge fences 94 and 96 integral with the base section 92 and extending along the front and aft edges, respectively, thereof. The fence 94 extends vertically upwardly from the front edge of the base section 92 and thence outwardly to abut against the front wall 22 of the cabinet 20 to space the caddies 80 away the front wall 22 so as to provide a gap 65 between the inner surface of the front wall 22 and the stacked caddies 80. The fence 96 extends vertically upwardly from the aft edge of the base section 92 and thence outwardly to abut against the back wall 24 of the cabinet 20 to space the caddies 80 away the back wall 24 so as to provide a gap 69 between the inner surface of the back wall 24 and the stacked caddies 80. The fences 94 and 96, being formed integrally with the base section 92 of the grate 90 are not fastened to the respective walls that they abut. Thus, the grate 90 may be quickly removed from the cabinet without tools for easy cleaning of the cabinet interior. As fasteners are not used to mount the fences 94 and 96 to the walls of the cabinet, the interior walls of the cabinet may be more thoroughly cleaned. Further, as no shelves are disposed within the chamber 30, no fasteners are needed to mount and support such shelves from the walls of the cabinet 20.

The forced air cooler 10 is provided with a refrigeration system comprising a pair of evaporators 52 and 54, a condenser 56 and a compressor 58 suitably arranged and connected in the conventional manner in refrigerant flow communication via coolant lines (not shown). The condenser 56 and the compressor 58 are disposed externally of the chamber 30 in a compartment 50 beneath the insulated floor panel 23 to insulate the chamber 30 from the heat developed by the condenser 56 and the compressor 58. The evaporators 52 and 54, which may comprise conventional fin and tube heat exchangers, are disposed in spaced relationship at opposite ends of the upper chamber 40 that lies superadjacent the chamber 30 within the region defined by the upper section 25*a* and forward and aft sections 25*b* and 25*c* of the top panel 25. A drip pan 48 extends beneath each of the evaporators 52 and 54 to catch any condensate that may drip off the evaporators. Coolant lines (not shown) extend along the side walls 26 and 28 to interconnect the evaporators 52 and 54 in coolant flow communication in the conventional manner with the condenser and the compressor.

Figure 4:
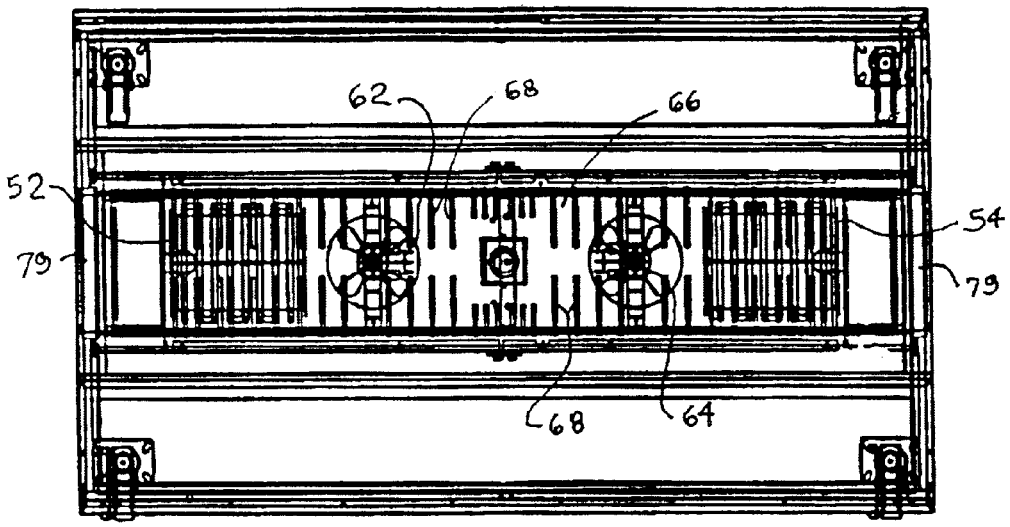
FIG. 4 is a sectional plan view taken along line 4—4 of FIG. 3.

The forced air cooler 10 further includes a cooling air circulation system having at least one air circulator disposed between the spaced evaporators 52 and 54, a diffuser plate 66, lower air return duct 70 and side air return ducts 76 and 78. Most advantageously, the air circulator 60 comprises two or more axial flow fans 62 and 64, disposed at spaced intervals within and along the length of the upper chamber 42 between the evaporators 52 and 54. As best seen in FIGS. 3 and 4, the fans 62 and 64 are suitably supported within the upper chamber 40 with the diffuser plate 66 extending longitudinally beneath the fans between the upper chamber 40 and the lower chamber 30. The diffuser plate 66 has a plurality of openings 68 therethrough that are distributed along the length of the diffuser plate 66 and serve to provide passages through which the cool air having passed through either of the evaporators 52 and 54 is conveyed by fans 62 and 64 distributed across substantially the entire expanse of the lower chamber 30 and over the surface of the articles housed therein. In the preferred embodiment as illustrated in FIG. 3, the openings comprise longitudinally spaced slots 68 that extend generally transversely to the longitudinally extending diffuser plate 66. It is to be understood, however, that the openings 68 in the diffuser plate 66 may comprise holes of any shape distributed over the surface of the diffuser plate in any desirable pattern without departing from the spirit and scope of the present invention.

The lower air return duct 70 ties on the surface of the floor 23 of the lower chamber 30 generally equally spaced from the front and back walls of the lower chamber 30 and extends along the longitudinal length of the lower chamber 30 from one side wall to the other side wall. The lower air return duct 70 comprises a sheet metal member having an upper base plate and side flanges 71 and 73 extending downwardly to the floor 23 of the lower chamber 30 to define a bottom return airflow passage 75 having an air outlet at each end thereof. The flanges 71 and 73 are perforated with a plurality of holes 77 along substantially the entire length of the flanges. Side air return ducts 76 and 78 extend upwardly along the left and right side walls 26 and 28, respectively, from their respective air inlets superadjacent the floor 23 of the chamber 30 to their respective air outlets 79 opening into the upper chamber 40 at the opposite ends thereof. The air inlets of the side air return ducts 76 and

78 mate with the air outlets at the respective longitudinally spaced ends of the lower air return duct 70 to receive airflow therefrom.

This air circulation system produces the very efficient cooling airflow illustrated in FIG. 3 by the line of arrows. The fans 62 and 64 draw air through the evaporators 52 and 54, respectively. As the airflow traverses the evaporators, it is cooled as it passes over the finned tubes through which coolant is passing. The cooling air leaving the evaporators is then driven by the fans through the openings provided by the slots 68 in the diffuser plate 66 to provide a uniformly distributed flow of cooling air across the surface of the articles disposed within the lower chamber 30 and downwardly into the lower chamber 30 to pass over the articles stored therein. Upon reaching the floor 23 of the lower chamber 30, the cooling airflow passes along the surface of the floor 23 and is drawn to the lower air return duct 70 through the holes 77 in the side flanges 71 and 73 thereof into the bottom airflow passage 70. The airflow then passes from the bottom airflow passage 75 via the outlets of the lower air return duct 70 through the respective inlets into the side air ducts 76 and 78 that extend vertically along side walls 26 and 28, respectively, and passes upwardly therethrough to exit through the outlets 79 to return to the upper chamber 40 and be again drawn through the evaporators 52 and 54.

With this air circulation system, the coolest airflow is introduced into the lower chamber 30 uniformly across and above the product stored therein to flow downwardly over and amongst the product, not only being driven by the fans 62 and 64, but also with the aid of gravity. Additionally, a portion of the coolest cooling air will flow downwardly across the openings 35 and 45 so as to establish an air curtain that isolates the product within the lower chamber 30 from the ambient temperature in external environment. Further, after having lost its coolest condition as it traverses the product, the cooling air reaches the bottom of the chamber 30 and flows through the gap 55 extending beneath the product along the surface of the floor 23 to and through the holes 75 in the side flanges 71 and of the lower air return duct 70, rather then passing back over the product, thereby avoiding possible rewarming of the product. Still further, the return cooling air, being at its least cool condition, passes through the lower air return duct 70 into and upwardly through the side air ducts 76 and 78 wherein it is isolated from the articles 80 stored within the lower chamber 30. Additionally, as the articles stored within the lower chamber 30 are spaced from the front and back walls 22 and 24 by the fences 94 and 96, cooling air may pass downwardly through gaps 65 and 67 along the walls 22 and 24, respectively, thereby ensuring that all product is surrounded by cooling air. In this manner, very efficient and effective cooling of the product is ensured even when the openings 35 and 45 are open for access to the product stored within the forced air cooler 10 of the present invention.

The aforementioned description is meant to be exemplary rather than limiting. Many modifications and variations of the present invention as described may be recognized by those skilled in the art in light of the above teachings that will fall within the spirit and scope of the present invention. The preferred embodiments of this invention have been disclosed. Accordingly, within the scope of the appended claims, the invention may be practiced otherwise than as specifically described. For this reason the following claims should be studied to determine the true scope and content of this invention.

What is claimed is:

1. A cooler comprising:

a cabinet having a front wall, a back wall, first and second longitudinally spaced side walls, a insulated floor panel and a insulated top panel cooperatively defining a lower chamber for housing articles to be cooled and an upper chamber disposed superadjacent said lower chamber;

a generally horizontally disposed diffuser plate positioned between said lower chamber and said upper chamber, said diffuser plate having a plurality of openings passing therethrough;

at least one evaporator disposed within said upper chamber for cooling air passing therethrough;

at least one air circulator disposed within said upper chamber in operative association with said at least one evaporator for generating a flow of cooling air passing through said at least one evaporator;

first and second generally vertically extending air intern ducts, each having an inlet opening superadjacent said floor and an outlet opening into said upper chamber, said first air return duct lying along side first side wall and said second air return duct lying along said second side wall;

a lower return air duct defining a bottom airflow passage lying superadjacent said floor and extending beneath the articles housed within said lower chamber, said lower air return duct having a generally horizontal, longitudinally extending base disposed in spaced relationship with and above said floor of said chamber, said bottom airflow passage in flow communication with each of said air return ducts, and a support grate having a relatively open framework and including a generally horizontally extending deck extending superadjacent said floor, a first edge fence integral with said deck and extending generally vertically upwardly from a first edge of said deck and thence outwardly to abut said front wall, and a second edge fence integral with said deck and extending generally vertically upwardly from a second edge of said deck and thence outwardly to abut said back wall.

* * * * *